US012566020B2

(12) United States Patent
Park

(10) Patent No.: US 12,566,020 B2
(45) Date of Patent: Mar. 3, 2026

(54) REFRIGERATOR

(71) Applicant: LG Electronics Inc., Seoul (KR)

(72) Inventor: Hyunjin Park, Seoul (KR)

(73) Assignee: LG Electronics Inc., Seoul (KR)

( * ) Notice: Subject to any disclaimer, the term of this patent is extended or adjusted under 35 U.S.C. 154(b) by 113 days.

(21) Appl. No.: 18/409,171

(22) Filed: Jan. 10, 2024

(65) Prior Publication Data

US 2025/0172326 A1 May 29, 2025

(30) Foreign Application Priority Data

Nov. 29, 2023 (KR) ..... 10-2023-0169633

(51) Int. Cl.
*F25C 1/25* (2018.01)

(52) U.S. Cl.
CPC ..... *F25C 1/25* (2018.01); *F25C 2400/10* (2013.01); *F25C 2400/14* (2013.01)

(58) Field of Classification Search
CPC .... F25C 1/02; F25C 2400/10; F25C 2400/14; F25C 5/22; F25D 21/04
See application file for complete search history.

(56) References Cited

U.S. PATENT DOCUMENTS 3,866,434 A * 2/1975 Pugh ..... F25C 1/25 62/340
2019/0041119 A1* 2/2019 Kim ..... F25D 17/08
2019/0128595 A1* 5/2019 Gan ..... F25D 23/126
2024/0175619 A1* 5/2024 Cho ..... F25D 17/065

OTHER PUBLICATIONS koreaittimes.com, "LG showcases advanced home appliances at KBIS 2023," Feb. 1, 2023, retrieved Jan. 9, 2024 from URL <https://www.koreaittimes.com/news/articleView.html?idxno=119021>, 4 pages.
LG Electronics, Inc., "Related figures (1) to (3) for the subject matters," mailed on Jan. 9, 2024, 3 pages.

* cited by examiner

*Primary Examiner* — Elizabeth J Martin
*Assistant Examiner* — Adam Dorrel Moore
(74) *Attorney, Agent, or Firm* — Fish & Richardson P.C.

(57) ABSTRACT

In a refrigerator, an end portion of a water supply tube, facing an ice maker, is placed closer to the lower surface of a guide tube than to the upper surface of the guide tube, for water from the water supply tube to be discharged along the lower surface of the guide tube, such that water going past a water discharge area of the guide tube adjacent to a freezer compartment sweeps across the entire inner surface of the guide tube as much as possible at a time when water is supplied.

21 Claims, 11 Drawing Sheets

REFRIGERATOR

CROSS-REFERENCE TO RELATED APPLICATION

This application claims priority to and the benefit of Korean Patent Application No. 10-2023-0169633, filed on Nov. 29, 2023, the disclosure of which is incorporated herein by reference in its entirety.

TECHNICAL FIELD

The present disclosure relates to a refrigerator, and in particular, a refrigerator comprising a guide tube.

BACKGROUND

Refrigerators produce cold air, based on a circulation of refrigerants, and supply the cold air to a storage compartment, to keep a variety of storage targets fresh in the storage compartment for a long period of time.

A refrigerator comprises an ice maker producing ice with cold air, and the ice maker produces a certain amount of ice in advance and store the ice.

For the ice maker to produce ice, water supplied from a water supply source or a water tank is accommodated in an ice tray.

The water supplied from the water supply source or the water tank may be provided to the ice maker through a guide tube.

Referring to FIG. 13, a guide tube 90 extends in such a way that the guide tube 90 goes past a foaming area 94, and one end portion of the guide tube 90 communicates with a freezer compartment 93 in which an ice maker is placed by passing through a bracket 91.

A hot wire 92 is disposed outside the guide tube 90 going past the foaming area 94, to prevent frost generation in an area adjacent to the freezer compartment 93.

However, the temperature of the end portion of the guide tube 90, where the hot wire 92 is hardly disposed, remains lower than the temperature of any other portion of the guide tube 90, where the hot wire 92 is disposed.

Accordingly, a relatively cold iced wet vapor of the freezer compartment 93 may be drawn through the end portion of the guide tube 90 exposed to the freezer compartment 93.

The iced wet vapor 96 may meet a relatively warm wet vapor of supplied water 95, which is drawn along the guide tube 90.

As the wet vapor of supplied water 95 meets the iced wet vapor 96, a sublimation point is formed, and frosting 97 may occur near the area where the sublimation point is formed.

Such frosting may often occur in the end portion area of the guide tube 90 provided with no hot wire 92 and exposed to the freezer compartment 93.

Such frosting 97 occurs, frost is generated inside the guide tube 90, and as frost is grown, the guide tube 90 is clogged.

The frost generated inside the guide tube 90 may be removed by water going past the inner side of the guide tube 90.

However, in the case where water drawn through the guide tube 90 is eccentrically discharged, like water drawn through the guide tube 90 is drawn only along one inner surface the guide tube 90, frost on the inner surface of the guide tube 90, where water does not go past, is not removed.

SUMMARY

The objective of the present disclosure is to provide a refrigerator that enables water going past a water discharge area of a guide tube to sweep across the entire inner surface of the guide tube as much as possible.

The objective of the present disclosure is to provide a refrigerator that reduces the growth of frost on the inner surface of the guide tube.

The objective of the present disclosure is to provide a refrigerator that solves the problem of position dispersion of a water supply tube, which may occur in the case where the water supply tube is inserted into the guide tube.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via means and combinations thereof that are described in the appended claims.

A refrigerator in one aspect comprises a cabinet comprising one or more of storage compartments, an ice maker disposed in the storage compartment, a guide tube forming a water supply flow path through which water is guided to the ice maker, and a water supply tube inserted into the guide tube and configured to supply water.

An end portion of the water supply tube, facing the ice maker, may be placed closer to a lower surface of the guide tube than to an upper surface of the guide tube.

The end portion of the water supply tube may contact the lower surface of the guide tube.

The guide tube may comprise an upper press part pressing an upper surface of the water supply tube in a downward direction.

An area of the guide tube, corresponding to the upper press part, may bend in the downward direction.

An upper protrusion part protruding in the downward direction may be formed in an area of an inner side of the guide tube, corresponding to the upper press part.

The guide tube may further comprise a lower press part pressing a lower surface of the water supply tube in an upward direction.

An area of the guide tube, corresponding to the lower press part, may bend in the upward direction.

A lower protrusion part protruding in the upward direction may be formed in an area of an inner side of the guide tube, corresponding to the lower press part.

The upper press part may be closer to the end portion of the water supply tube than the lower press part.

A distance between the upper press part and the lower press part may be greater than an inner diameter of the guide tube.

The guide tube may comprise a first extension part, a second extension part, and a third extension part that connect consecutively along a direction in which water is discharged, the second extension part may comprise a downward inclination surface, and the guide tube may bend at the second extension part.

An end portion of the guide tube may be placed at the second extension part.

At least a partial area of the guide tube placed at the first extension part and the second extension part may respectively contact an upper surface of the first extension part and an upper surface of the second extension part.

At least a partial area of the guide tube placed at the second extension part may also contact a lower surface of the second extension part.

Water discharged from the water supply tube may flow to the third extension part along a lower surface of the second extension part.

Water passing through the third extension part may flow along an entire inner surface of the third extension part.

The third extension part may extend in an up-down direction in such a way that an inclination angle of the third extension part is greater than an inclination angle of the second extension part.

The guide tube may comprise a pair of lateral press parts pressing both lateral surfaces of the water supply tube.

The water supply tube placed at the lateral press parts may be disposed along a center line of the lower surface of the guide tube.

The storage compartment may comprise a first storage compartment and a second storage compartment, the ice maker may be disposed in the second storage compartment, and one end and the other end of the guide tube may respectively fluidly communicate with the first storage compartment and the second storage compartment.

The guide tube may be disposed between the first storage compartment and the second storage compartment, a hot wire may be provided along an outer surface of the guide tube, and the guide tube may go past a foaming area between the first storage compartment and the second storage compartment.

In a refrigerator of the present disclosure, an end portion of a water supply tube, facing an ice maker, may be placed closer to a lower surface of a guide tube than an upper surface of the guide tube, to enable water from the water supply tube to be discharged along the lower surface of the guide tube, such that water going past a water discharge area of the guide tube adjacent to a freezer compartment sweeps across an entire inner surface of the guide tube as much as possible at a time when water is supplied.

Accordingly, eccentrically discharged water, i.e., water that is discharged in such a way that the water is eccentric to the surface at one side of the guide tube while flowing in the guide tube, may be prevented, such that frost is prevented from being grown on the inner surface of the guide tube as much as possible, where water does not go past.

The refrigerator of the present disclosure may comprise a lateral press part pressing both lateral surfaces of the water supply tube that is inserted into the guide tube, such that the water supply tube is placed along a center line of the guide tube.

Thus, eccentrically discharged water, i.e., water that is discharged in such a way that the water is eccentric to the surface at one side of the guide tube while flowing in the guide tube, may be prevented, such that frost is prevented from being grown on the inner surface of the guide tube as much as possible, where water does not go past.

Further, the refrigerator of the present disclosure may further comprise a press part pressing the water supply tube in an upward direction or a downward direction, for the water supply tube disposed in the guide tube to bend at a predetermined angle, such that the problem of position dispersion that may occur in the case where the water supply tube is inserted into the guide tube is solved.

Specific effects are described along with the above-described effects, in the section of detailed description.

BRIEF DESCRIPTION OF DRAWINGS

The accompanying drawings constitute a part of the specification, illustrate one or more embodiments in the disclosure, and together with the specification, explain the disclosure, wherein.

DETAILED DESCRIPTION

Figure 1:
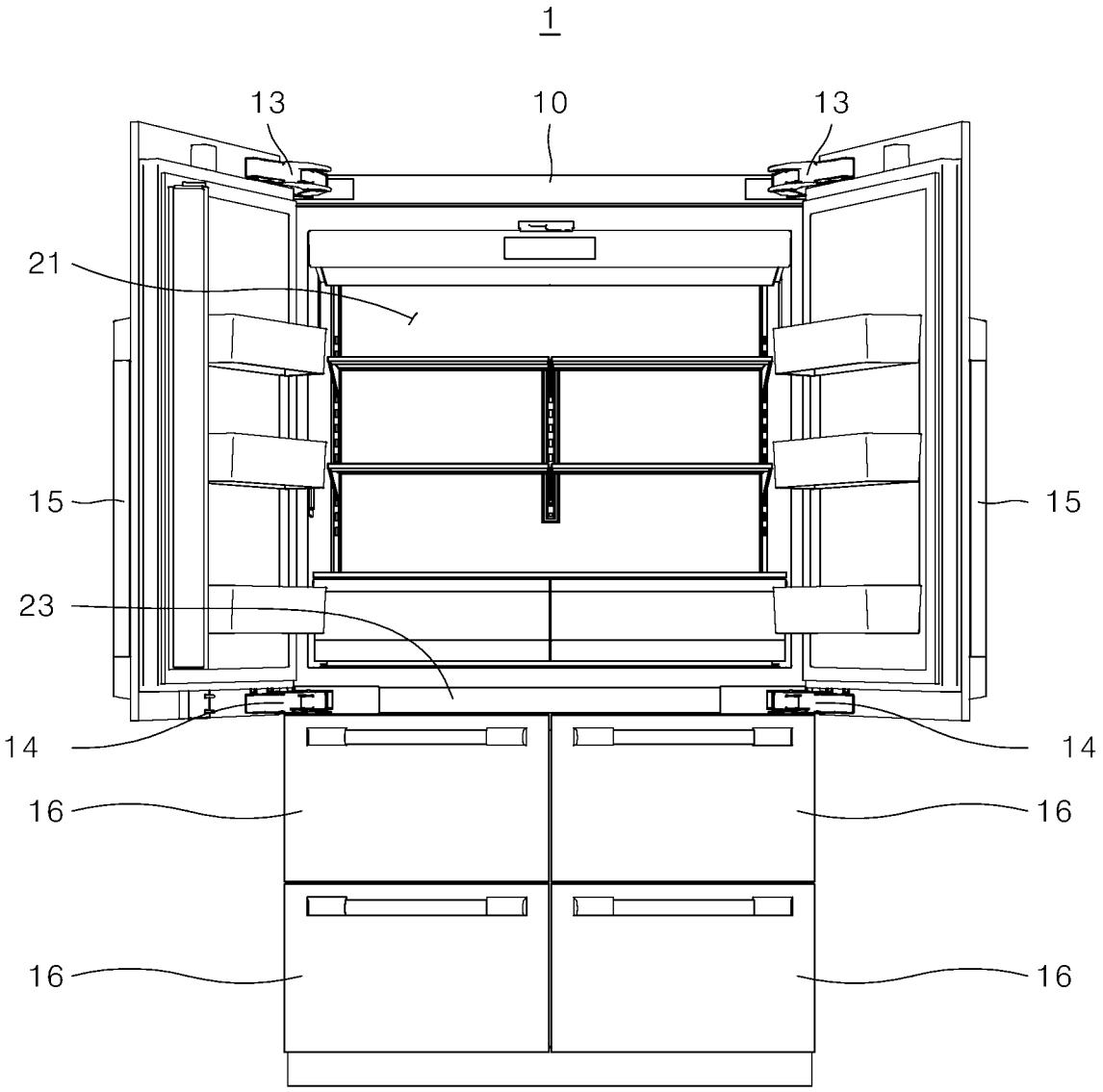
FIG. 1 is a front view of a refrigerator with its upper doors open.
Figure 2:
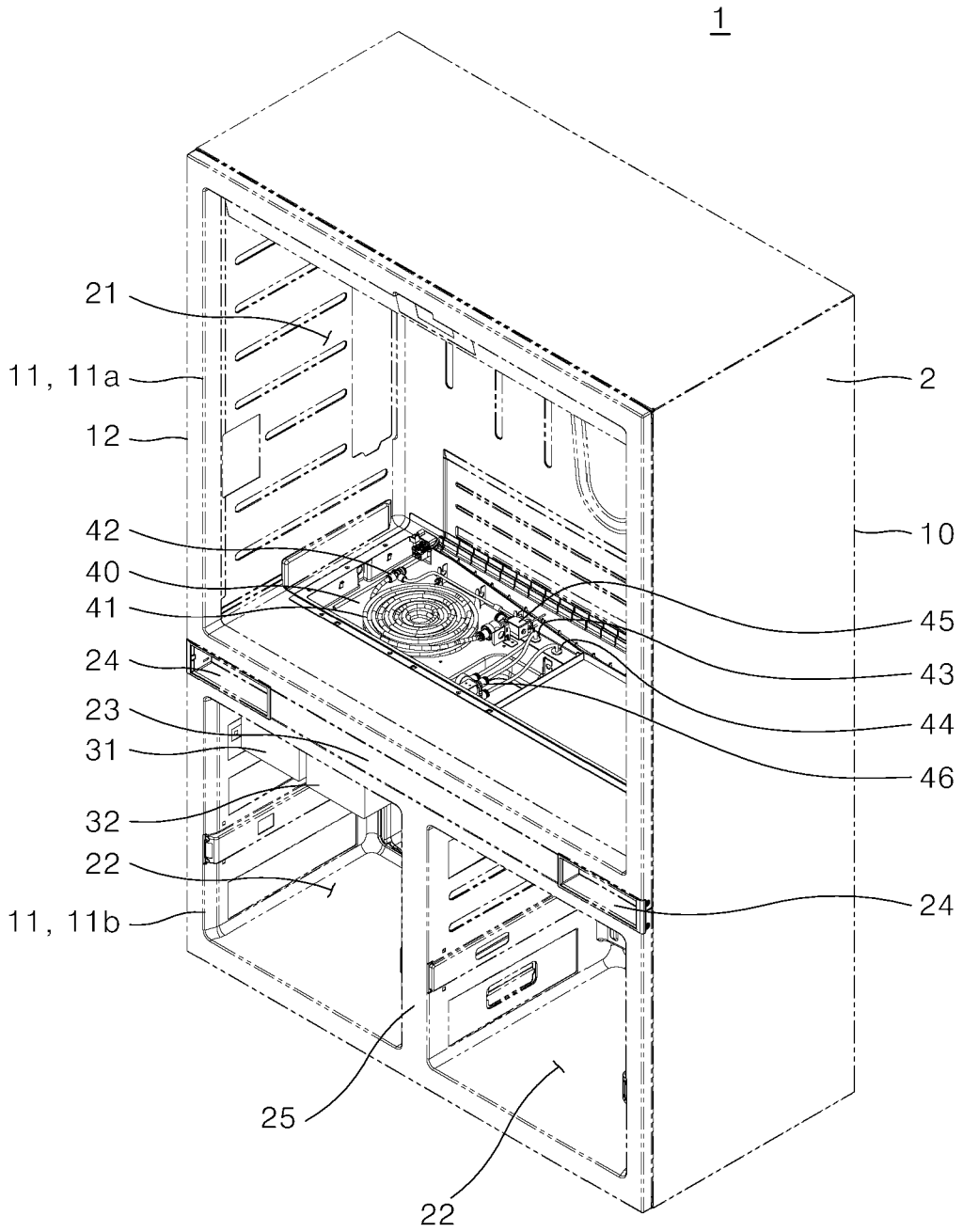
FIG. 2 is a front perspective view of a refrigerator with its doors open.
Figure 3:
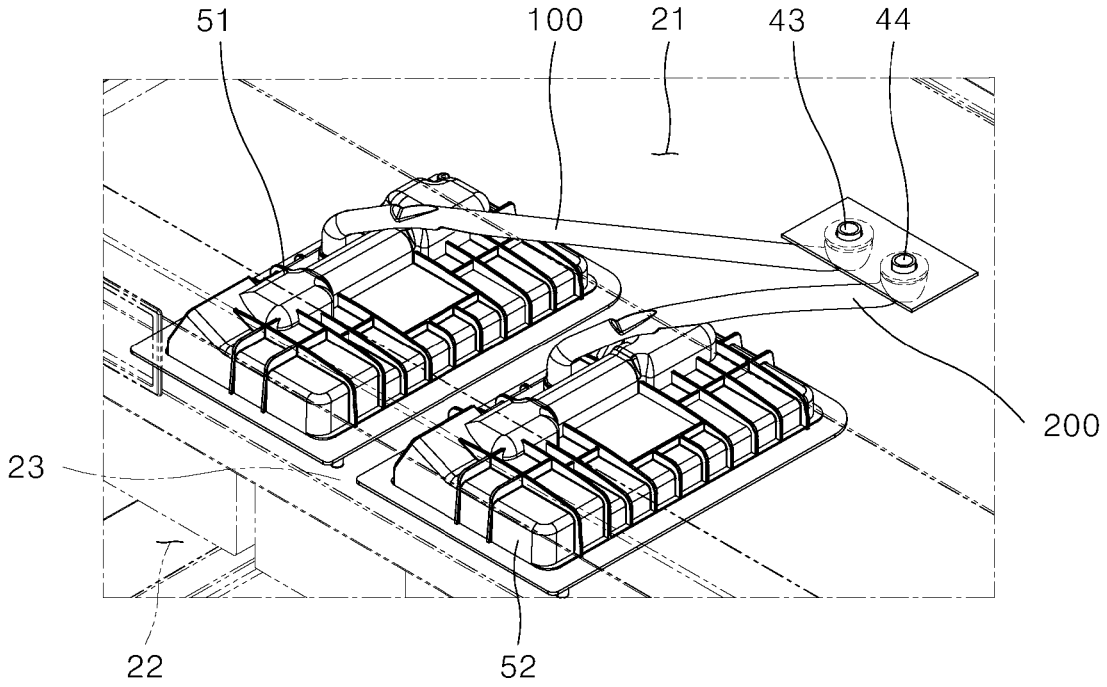
FIG. 3 is a view of a guide tube and a bracket that are disposed at a barrier part.
Figure 4:
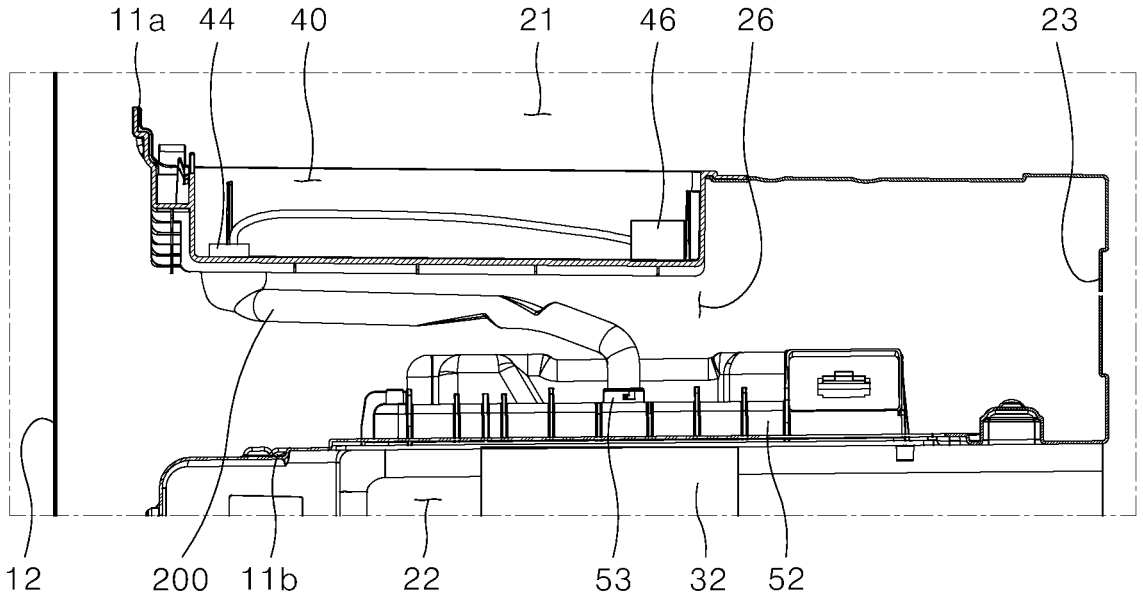
FIG. 4 is a lateral cross-sectional view of a connection relationship between a guide tube and a bracket that are disposed between a first storage compartment and a second storage compartment.
Figure 5:
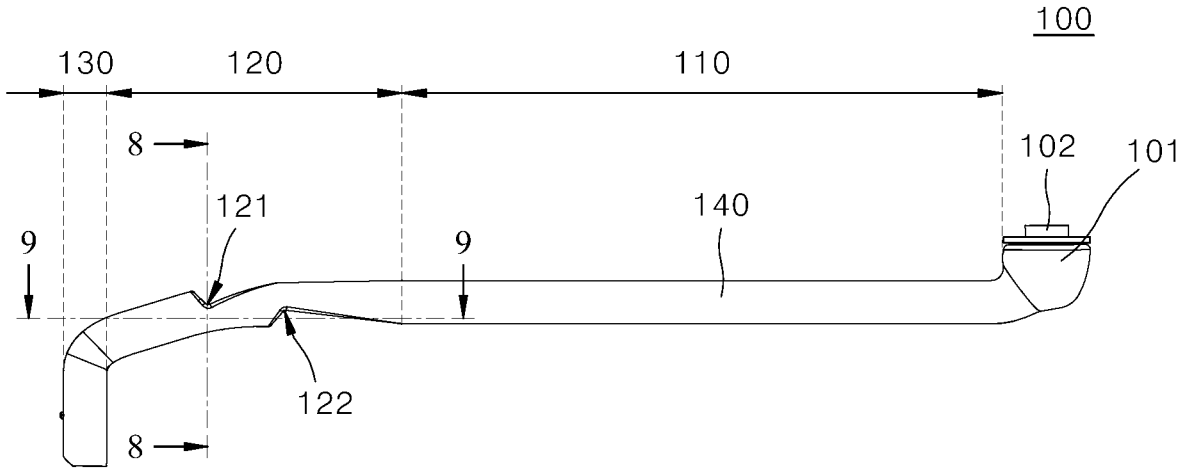
FIG. 5 is a side view of a first guide tube.
Figure 6:
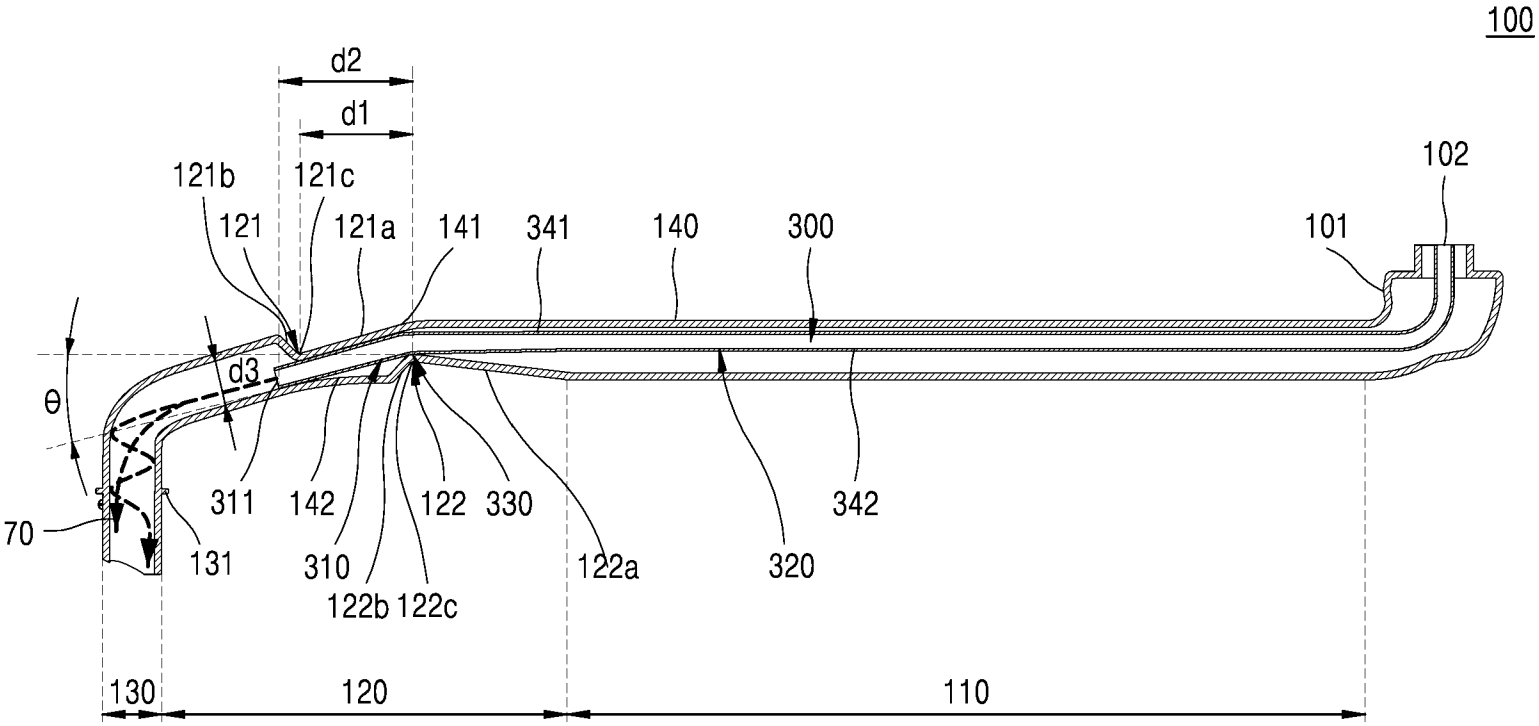
FIG. 6 is a lateral cross-sectional view of a first guide tube.

The above-described aspects, features and advantages are specifically described hereinafter with reference to accompanying drawings such that one having ordinary skill in the art to which the subject matter of the present disclosure pertains can embody the technical spirit of the disclosure easily. In the disclosure, detailed description of known technologies in relation to the subject matter of the disclosure is omitted if it is deemed to make the gist of the disclosure unnecessarily vague. Hereinafter, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components are not to be limited by the terms. Certainly, a first component can be a second component, unless stated to the contrary.

Throughout the disclosure, each component can be provided a single one or a plurality of ones, unless stated to the contrary.

When any one component is described as being "in the upper portion (or the lower portion)" or "on (or under)" another component, any one component can be directly on (or under) another component, and an additional component can be interposed between the two components.

When any one component is described as "being connected", "being coupled" or "being connected" to another component, any one component can be directly connected or coupled to another component, but an additional component can be "interposed" between the two components or the two components can be "connected" or "coupled" by an additional component.

In the disclosure, singular forms include plural forms as well, unless explicitly indicated otherwise. In the disclosure, the terms "comprise", "being comprised of" and the like do not imply necessarily including stated components or stated steps and imply excluding some of the stated components or stated steps or including additional components or additional steps.

Throughout the disclosure, the terms "A and/or B" as used herein can denote A, B or A and B, and the terms "C to D" can denote C or greater and D or less, unless stated to the contrary.

Hereinafter, a refrigerator of several embodiments is described.

A refrigerator comprising a guide tube of one embodiment is described with reference to FIGS. 1 to 4.

The exterior of a refrigerator 1 may be formed by a cabinet 10 that has one or more of storage compartments 21, 22 as a storage space of items, therein, and by a plurality of door 15, 16 that may open and close the front surface of the cabinet 10, which is open.

The cabinet 10 may comprise an outer case 12 and an inner case 11 coupled to the inner side of the outer case 12.

The inner case 11 may be provided in such a way that a first inner case 11*a* is placed in the upper portion of the inner case 11, while a second inner case 11*b* is placed in the lower portion of the inner case 11.

The first inner case 11*a* may comprise one or more of first storage compartments 21 that may be a refrigerator compartment, and the second inner case 11*b* may comprise one or more of second storage compartments 22 that may be a freezer compartment.

The first inner case 11*a* and the second inner case 11*b* may be respectively formed and separated from each other but not limited. The first inner case 11*a* and the second inner case 11*b* may be formed integrally.

A barrier part 23 may be formed between the first inner case 11*a* and the second inner case 11*b*, and partition a space between the first inner case 11*a* and the second inner case 11*b*.

The barrier part 23 may comprise a foaming area 26 filled with a thermal insulation material, thereinside.

Accordingly, the first storage compartment 21 and the second storage compartment 22 disposed in the up-down direction may be spaced a predetermined distance apart from each other by a space formed by the barrier part 23.

The barrier part 23 may be formed by the first inner case 11*a* and the second inner case 11*b* but not limited, and formed as an individual component apart from the first inner case 11*a* and the second inner case 11*b*.

The space of the second inner case 11*b* may be partitioned into a plurality of storage compartments 22 by a partition part 25 that extends in the up-down direction near the central portion of the second inner case 11*b* and partitions a space, in such a way that the plurality of second storage compartments 22 is disposed side by side, but not limited.

One or more of ice makers may be disposed in one second storage compartment 22.

For example, a first ice maker 31 and a second ice maker 32 may be disposed side by side in the left-right direction, and mounted on the upper surface of the inner side of the second storage compartment 22.

The first ice maker 31 and the second ice maker 32 may respectively produce ice having a different shape and a different size.

The first storage compartment 21 may be opened and closed by one or more of first doors 15.

For example, the first door 15 may be a pair of rotary doors rotated by an upper hinge 13 and a lower hinge 14 that respectively connect to the upper portion and the lower portion of the first door 15.

A pair of hinge mounting parts 24 to which the lower hinge 14 is inserted and fixed may be placed at both sides of the barrier part 23.

The second storage compartment 22 may be opened and closed by one or more of second doors 16.

For example, the second door 16 may be a drawer-type door that is inserted and drawn by a rail.

Additionally, a storage part 40 may be formed on the lower surface of the inner side of the first storage compartment 21, in such a way that the storage part 40 is depressed in a downward direction.

The storage part 40 may be formed to correspond to the upper area of the second storage compartment 22, in which the first ice maker 31 and the second ice maker 32 are placed.

A water tank 41 storing water that is supplied to the ice maker 31, 32 may be disposed in the storage part 40.

For example, the water tank 41 may be a tube-type water tank in which an elongated pipe having a predetermined width coils up like a coil, but not limited.

The water tank 41 may be provided with water from an external water source.

A branch connector 42 may be disposed in the storage part 40 and guide water supplied from the external water source to the water tank 41.

One side of the water tank 41 may connect to a first valve 45, and like a dispenser (not illustrated), the first valve 45 may allow water to flow selectively to a place in need of water in addition to the ice maker.

One side of the branch connector 42 may connect to the second valve 46, and the second valve 46 may connect to a first pipe hole 43 and a second pipe hole 44, and allow water to flow selectively to the first pipe hole 43 and the second pipe hole 44.

The first pipe hole 43 may be a passage for supplying water to the first ice maker 31, and the second pipe hole 44 may be a passage for supplying water to the second ice maker 32.

For water to be supplied to the first ice maker 31 and the second ice maker 32 through the first pipe hole 43 and the second pipe hole 44, a first guide tube 100 and a second guide tube 200 may be disposed in the barrier part 23.

Additionally, in the barrier part 23, a first bracket 51 disposed on the first ice maker 31 to finish the upper portion of the first ice maker 31 and configured to provide a passage through which water is supplied to the first ice maker 31, and a second bracket 52 disposed on the second ice maker 32 to finish the upper portion the second ice maker 32 and configured to provide a passage through which water is supplied to the second ice maker 32 may be disposed.

The first bracket 51 and the second bracket 52 may be disposed on the second inner case 11*b* and fastened to the upper surface of the outer side of the second inner case 11*b*.

For example, one side of the first guide tube 100 may connect to the first pipe hole 43, and the other side of the first guide tube 100 may connect to the first bracket 51.

Further, one side of the second guide tube 200 may connect to the second pipe hole 44, and the other side of the second guide tube 200 may connect to the second bracket 52.

The first guide tube 100 may be inserted into a bracket hole 53 of the first bracket 51 and connect to the first bracket 51, and the end portion of the first guide tube 100 may pass through the bracket hole 53 and be inserted into the first bracket 51, to be exposed to the second storage compartment 22.

Additionally, the second guide tube 200 may be inserted into a bracket hole 53 of the second bracket 52 and connect to the second bracket 52, and the end portion of the second guide tube 200 may pass through the bracket hole 53 and be inserted into the second bracket 52, to be exposed to the second storage compartment 22.

Figure 12:
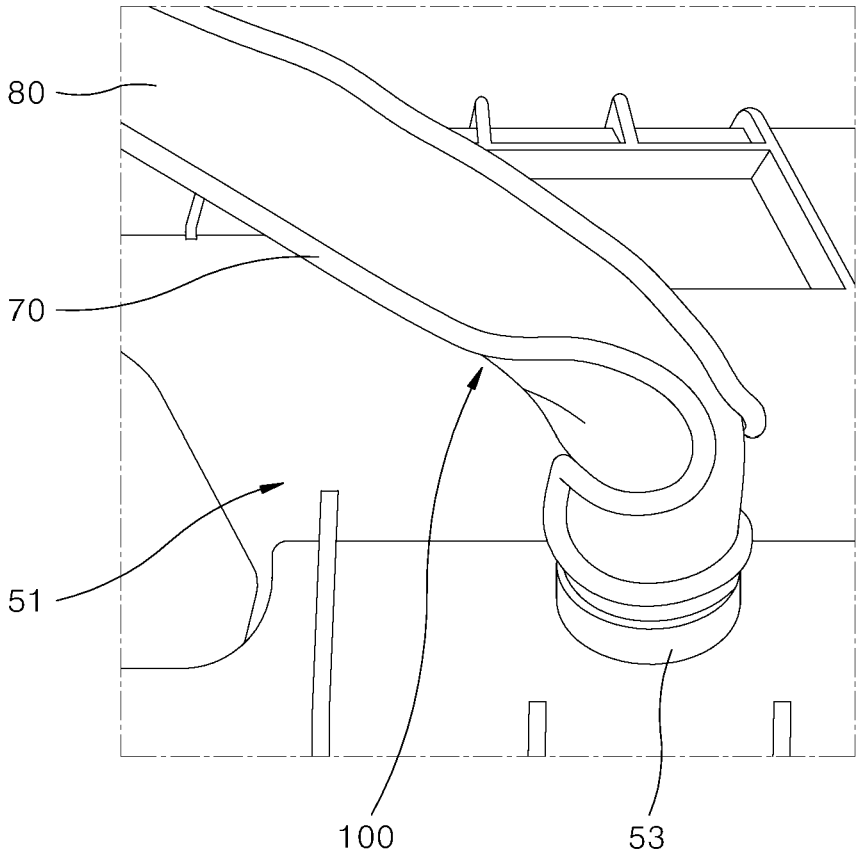
FIG. 12 is a view of a first guide tube provided with a hot wire.
Figure 13:
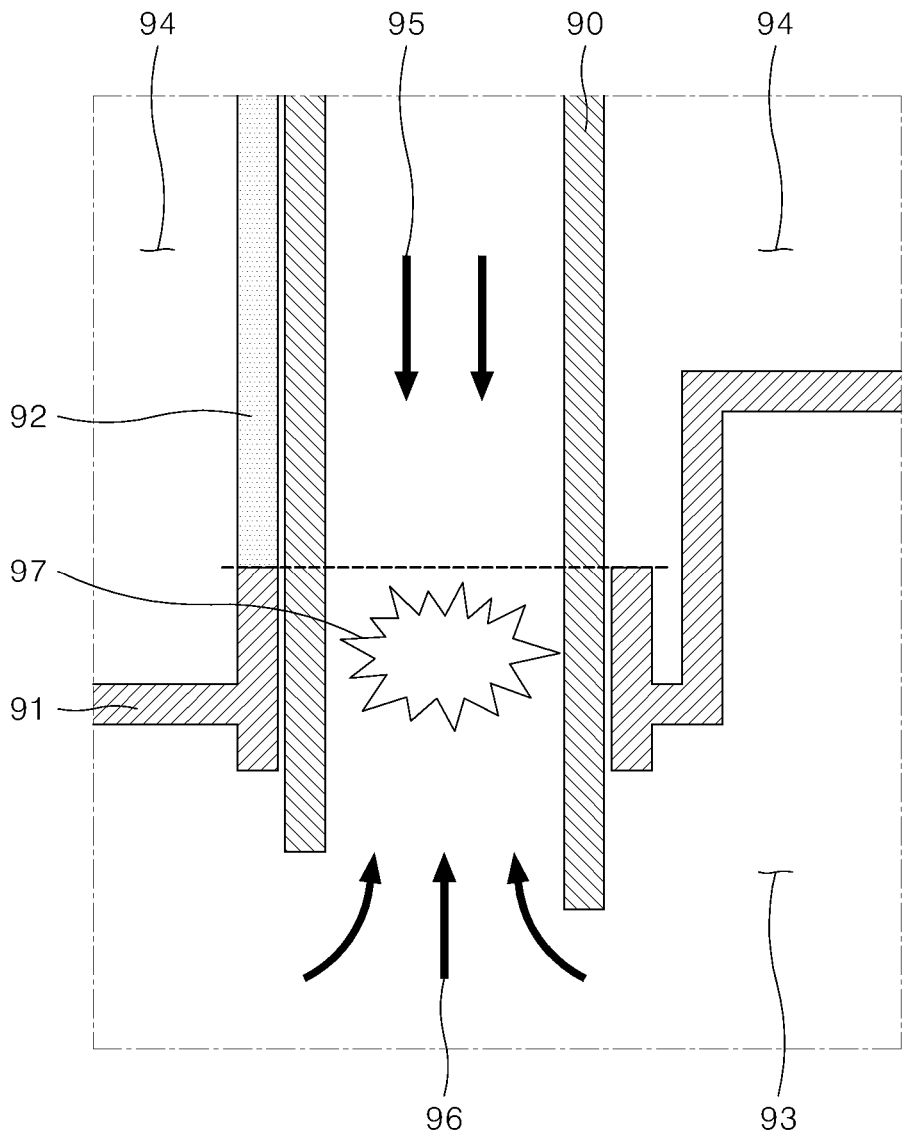
FIG. 13 is a view for describing ice formation in a water discharge area of a guide tube.

Referring further to FIG. 12, a hot wire 60 may be disposed outside the first guide tube 100 and the second guide tube 200.

For example, the hot wire 60 may be disposed to surround the outer surfaces of the first guide tube 100 and the second guide tube 200.

The hot wire 60 may be a linear hot wire that is elongated to surround a partial area of the outer surfaces of the guide tubes.

However, the hot wire 60 may not be limited to the above one, and provided as a surface hot wire to surround the outer surface of the guide tube entirely.

A conductive sheet 80 may be disposed between the guide tube and the hot wire 60.

The conductive sheet 80 may be formed to surround the outer surface of the guide tube, and help heat provided from the hot wire 60 to be delivered evenly to the entire outer surface of the guide tube.

For example, the conductive sheet 80 may be a metal-based sheet such as an aluminum sheet, but not limited.

The first guide tube 100 and the second guide tube 200 may be placed in the foaming area 26 in such a way that the first guide tube 100 and the second guide tube 200 penetrate the foaming area 26.

Hereinafter, the first guide tube 100 is described specifically with further reference to FIGS. 5 to 8.

The first guide tube 100 may comprise a connection part 101 that connects to the first pipe hole 43, and a tube body part 140 that is elongated from the connection part 101 in one direction.

The first guide tube 100 may form a water supply flow path through which water is guided to the ice maker 31.

A connection hole 102 may be formed on the upper surface of one side of the connection part 101 and be open in an upward direction.

The connection hole 102 may fluidly communicate with the first pipe hole 43, and provide a passage through which a water supply tube 300 is inserted into the first guide tube 100.

The tube body part 140 that extends approximately in the left-right direction may connect to the lateral surface at the other side of the connection part 101.

The tube body part 140 may comprise a first extension part 110, a second extension part 120 and a third extension part 130 that connect consecutively along a direction in which water is discharged.

Accordingly, the first extension part 110 may be the closest to the connection hole 102, and the third extension part 130 may be the farthest from the connection hole 102.

At least a partial area of the first extension part 110 may comprise a section that extends in a horizontal direction.

For example, the first extension part 110 may be formed as a section that extends in the horizontal direction as a whole, or comprise a section that extends in the horizontal direction only in a partial area of the first extension part 110.

However, preferably, the first extension part 110 has more section that extends in the horizontal direction, with respect to the entire section of the first extension part 110.

Additionally, the first extension part 110 may be elongated in such a way that the first extension part 110 inclines in the downward direction rather than in the horizontal direction.

Preferably, the inclination angle of the first extension part 110, at which the first extension part 110 inclines downward in a direction close to in the horizontal direction, is small/the first extension part 110 may incline downward in a direction close to the horizontal direction, at a small inclination angle.

Since the first extension part 110 comprises a section extending in the horizontal direction, or the inclination angle of the first extension part 110, at which the first extension part 110 inclines downward in a direction close to the horizontal direction, is small/the first extension part 110 may incline downward in a direction close to the horizontal direction, at a small inclination angle, the spatial availability in the barrier part 23 of a narrow up-down width may improve.

At least a partial area of the second extension part 120 may comprise an inclination surface that inclines in the downward direction.

For example, the second extension part 120 may be formed as a section comprised of a downward inclination surface entirely, or comprise a section comprised of a downward inclination surface only in a partial area of the second extension part 120.

However, preferably, the second extension part 120 has more sections that incline in the downward direction, with respect to the entire section of the second extension part 120.

The second extension part 120 may extend in the left-right direction in such a way that the inclination angle of the second extension part 120 is greater than the inclination angle of the first extension part 110.

Accordingly, water drawn through the connection part 101 may readily flow to the second extension part 120 past the first extension part 110, without staying in the first extension part 110.

At least a partial area of the third extension part 130 may comprise an inclination surface that inclines in the downward direction.

The third extension part 130 may extend in the left-right direction in such a way that the inclination angle of the third extension part 130 is greater than the inclination angle of the second extension part 120.

For example, the third extension part 130 may extend in a perpendicular direction as a whole, or may extend in the up-down direction in such a way that the third extension part 130 has an inclination angle close to the perpendicular direction.

Accordingly, water drawn through the connection part 101 may readily flow to the third extension part 130 past the second extension part 120, without staying in the second extension part 120.

Further, since the third extension part 130 is formed in such a way that the third extension part 130 extends in the perpendicular direction as a whole, the end portion of the third extension part 130 may be readily inserted into and fixed to the bracket hole 53 formed on the upper surface of the first bracket 51.

One or more of projections parts 131 may be formed along the outer circumferential part of the third extension part 130.

The projection part 131 may be fastened to the bracket hole 53 of the first bracket 51, to fix the end portion of the first guide tube 100 to the bracket hole 53 of the first bracket 51.

A water supply tube 300 supplying water may be inserted into and fixed to the first guide tube 100.

For example, the water supply tube 300 may pass through the connection hole 102 of the first guide tube 100 through the first pipe hole 43 exposed in the direction of the first storage compartment 21, and be inserted into the tube body part 140.

The water supply tube 300 may be made of a flexible material, and as an example, made of a plastic material such as poly vinyl chloride (PVC).

The inner diameter of the water supply tube 300 may be less than the inner diameter of the first guide tube 100.

Accordingly, the water supply tube 300 may be flexibly deformed along the inner shape of the first guide tube 100 and inserted into the first guide tube 100.

The end portion of the water supply tube 300, facing the ice maker 31, may go past the first extension part 110 and be placed in the second extension part 120.

The second extension part 120 may have an upper press part 121 that is formed to press an upper surface 341 of the water supply tube 300 in the downward direction.

The upper surface 341 of the second extension part 120, corresponding to the upper press part 121, may bend in the downward direction.

For example, the upper press part 121 may be placed further downward than the upper surface 341 of the first extension part 110.

The upper press part 121 may be formed by a first side 121*a* having a downward inclination surface, and a second side 121*b* having an upward inclination surface.

Accordingly, the upper press part 121 comprising the first side 121*a* comprised of a downward inclination surface and the second side 121*b* comprised of an upward inclination surface may be formed on the upper surface 341 of the second extension part 120, extending from the upper surface 341 of the first extension part 110.

A point of inflection 121*c* corresponding to the bend point of the upper press part 121 may be formed between the first side 121*a* and the second side 121*b*.

The first side 121*a* may correspond to a long side the length of which is greater than the length of the second side 121*b*, and the second side 121*b* may correspond to a short side the length of which is less than the length of the first side 121*a*.

The upper press part 121 formed as described above may allow the water supply tube 300 to have a downward inclination surface and bend at a predetermined angle.

Accordingly, a bend part 330 bending to have a downward inclination surface may be formed on a lower surface 342 of the water supply tube 300.

The water supply tube 300 may be divided into a rear end portion 320 close to the first extension part 110 and a front end portion 310 close to the third extension part 130, with respect to the bend part 330.

The front end portion 310 may have an inclination surface that inclines further downward than the rear end portion 320.

The position of the bend part 330 of the water supply tube 300 may not be aligned with the position of the upper press part 121, and the bend part 330 of the water supply tube 300 may be placed closer to the first extension part 110 than the upper press part 121.

The upper press part 121 may press the front end portion 310 of the water supply tube 300 in the downward direction.

For example, at least a partial area of the water supply tube 300 that is inserted through the connection hole 102 may contact the upper surface 141 of the first extension part 110, at the first extension part 110, but not be limited.

Depending on the flexibility and elasticity of the water supply tube 300, at least a partial area of the water supply tube 300 may contact the lower surface 142 of the first extension part 110, at the first extension part 110.

At this time, the water supply tube 300 may contact the upper surface 141 or the lower surface 142 of the first guide tube 100, at the first extension part 110, but not simultaneously contact the upper surface 141 and the lower surface 142 of the first guide tube 100, at the same point of the water supply tube 300.

Additionally, at least a partial area of the water supply tube 300 may contact the upper surface 141 of the second extension part 120, at the second extension part 120.

Further, at least a partial area of the water supply tube 300 may contact the lower surface 142 of the second extension part 120, at the second extension part 120.

At this time, the water supply tube 300 may contact the upper surface 141 and the lower surface 142 of the first guide tube 100, and may simultaneously contact the upper surface 141 and the lower surface 142 of the first guide tube 100 at the same point of the water supply tube 300, at the second extension part 120.

An end portion 311 of the water supply tube 300 may be placed in the second extension part 120.

At this time, the end portion 311 of the water supply tube 300, bent by the upper press part 121, may be placed closer to the lower surface 142 of the first guide tube 100 than to the upper surface 141 of the first guide tube 100.

Preferably, the end portion 311 of the water supply tube 300 may contact the lower surface 142 of the first guide tube 100.

If the end portion 311 of the water supply tube 300 is closer to the upper surface 141 of the first guide tube 100 than to the lower surface 142 of the first guide tube 100, water discharged from the end portion 311 of the water supply tube 300 may flow along the upper surface 141 of the first guide tube 100.

In the case where the flow velocity of water discharged from the water supply tube 300 is high, the water may flow along the upper surface 141 of the third extension part 130 of the first guide tube 100 as well as the upper surface 141 of the second extension part 120 of the first guide tube 100.

In the case where the water flows along the upper surface 141 of the first guide tube 100 as described above, frost may not be removed by the water from the lower surface 142 or other areas of the first guide tube 100, where the water does not go past, and may be grown.

However, in the refrigerator 1 of the present disclosure, the end portion 311 of the water supply tube 300, facing the ice maker 31, is placed closer to the lower surface 142 of the first guide tube 100 than to the upper surface 141 of the first guide tube 100, such that water 70 from the water supply tube 300 is discharged along the lower surface 412 of the first guide tube 100.

In the case where the end portion 311 of the water supply tube 300, facing the ice maker 31, is placed closer to the lower surface 142 of the first guide tube 100 than to the upper surface 141 of the first guide tube 100, water discharged from the water supply tube 300 may be discharged by detouring the lower surface 142 of the first guide tube 100 as well as the upper surface 141 of the first guide tube 100, despite a high flow velocity of the water.

Discharging water by detouring the lower surface 142 of the water supply tube 300 as well as the upper surface 141 of the water supply tube 300 may denote discharging water by going past all the inner surfaces of the water supply tube 300, comprising a lateral surface connecting the upper surface 141 and the lower surface 142 of the water supply tube 300 as well as the upper surface 141 and the lower surface 142 of the water supply tube 300.

At this time, water 70 going past the water discharge area of the first guide tube 100 adjacent to the freezer compartment may sweep across the entire inner surface of the first guide tube 100 as much as possible, at a time of supply of water.

Since the water sweeps across and passes through the entire inner surface of the first guide tube 100, rather than only passing through the upper surface 141 of the first guide tube 100 as described above, frost may be prevented from being formed on the inner surface of the water supply tube 300.

That is, the refrigerator 1 according to the present disclosure may prevent eccentrically discharged water, i.e., water that is discharged in such a way that the water is eccentric to the surface at one side of the first guide tube 100 while flowing in the first guide tube 100, such that the growth of frost is prevented as much as possible on the inner surface of the first guide tube 100, where water does not go past.

Additionally, the second extension part 120 may further have a lower press part 122 that is formed to press the lower surface 342 of the water supply tube 300 in the upward direction.

The lower surface 342 of the second extension part 120, corresponding to the lower press part 122, may be formed to bend in the upward direction.

For example, the lower press part 122 may be placed further downward than the lower surface 342 of the first extension part 110.

The lower press part 122 may be formed by a first side 122*a* having an upward inclination surface and a second side 122*b* having a downward inclination surface.

Accordingly, the lower press part 122 comprising the first side 122*a* comprised of an upward inclination surface and the second side 122*b* comprised of a downward inclination surface may be formed on the lower surface 342 of the second extension part 120, extending from the lower surface 342 of the first extension part 110.

A point of inflection 122*c* corresponding to a bend point of the lower press part 122 may be formed between the first side 122*a* and the second side 122*b*.

The first side 122*a* may correspond to a long side the length of which is greater than the length of the second side 122*b*, and the second side 122*b* may correspond to a short side the length of which is less than the length of the first side 122*a*.

The lower press part 122 formed as described above may allow the water supply tube 300 to have a downward inclination surface and bend at a predetermined angle.

Accordingly, a bend part 330 may be formed on the lower surface 342 of the water supply tube 300 and bend to have a downward inclination surface.

The water supply tube 300 may be divided into a rear end portion 320 close to the first extension part 110 and a front end portion 310 close to the third extension part 130, with respect to the bend part 330.

The front end portion 310 may be formed to have an inclination surface that inclines further downward than the rear end portion 320.

For example, the inclination surface of the front end portion 310, inclining further downward than the rear end portion 320 with respect to the rear end portion 320, may have an inclination angle (θ) of 15° or greater, e.g., 17°.

The position of the bend part 330 of the water supply tube 300 may be aligned with the position of the lower press part 122.

The lower press part 122 may press the bend part 330 of the water supply tube 300 in the upward direction.

The upper press part 121 may be placed closer to the end portion 311 of the water supply tube 300 than the lower press part 122.

Additionally, a distance d1 between the upper press part 121 and the lower press part 122 may be greater than a distance d2 between the end portion 311 of the water supply tube 300 and the lower press part 122.

Further, the distance d1 between the upper press part 121 and the lower press part 122, and the distance d2 between the end portion 311 of the water supply tube 300 and the lower press part 122 may be greater than an inner diameter d3 of the first guide tube 100.

In the case where the distance d1 between the upper press part 121 and the lower press part 122, and the distance d2 between the end portion 311 of the water supply tube 300 and the lower press part 122 are too short, the water supply tube 300 passing between the upper press part 121 and the lower press part 122 is fitted between both the press parts, and the water supply tube may hardly be inserted and fail to be fitted.

This is caused by a difficulty in the bend of the water supply tube 300 as bend resistance increases on the upper surface and the lower surface of the water supply tube 300, and thus, the bend resistance of the water supply tube 300 needs to decrease.

In the present disclosure, the distance d1 between the upper press part 121 and the lower press part 122, and the distance d2 between the end portion 311 of the water supply tube 300 and the lower press part 122 are greater than the inner diameter d3 of the first guide tube 100, thereby reducing bend resistance, which may occur as the water supply tube 300 bends while passing through between the upper press part 121 and the lower press part 122, in the upper portion and the lower portion of the water supply tube 300.

Figure 7:
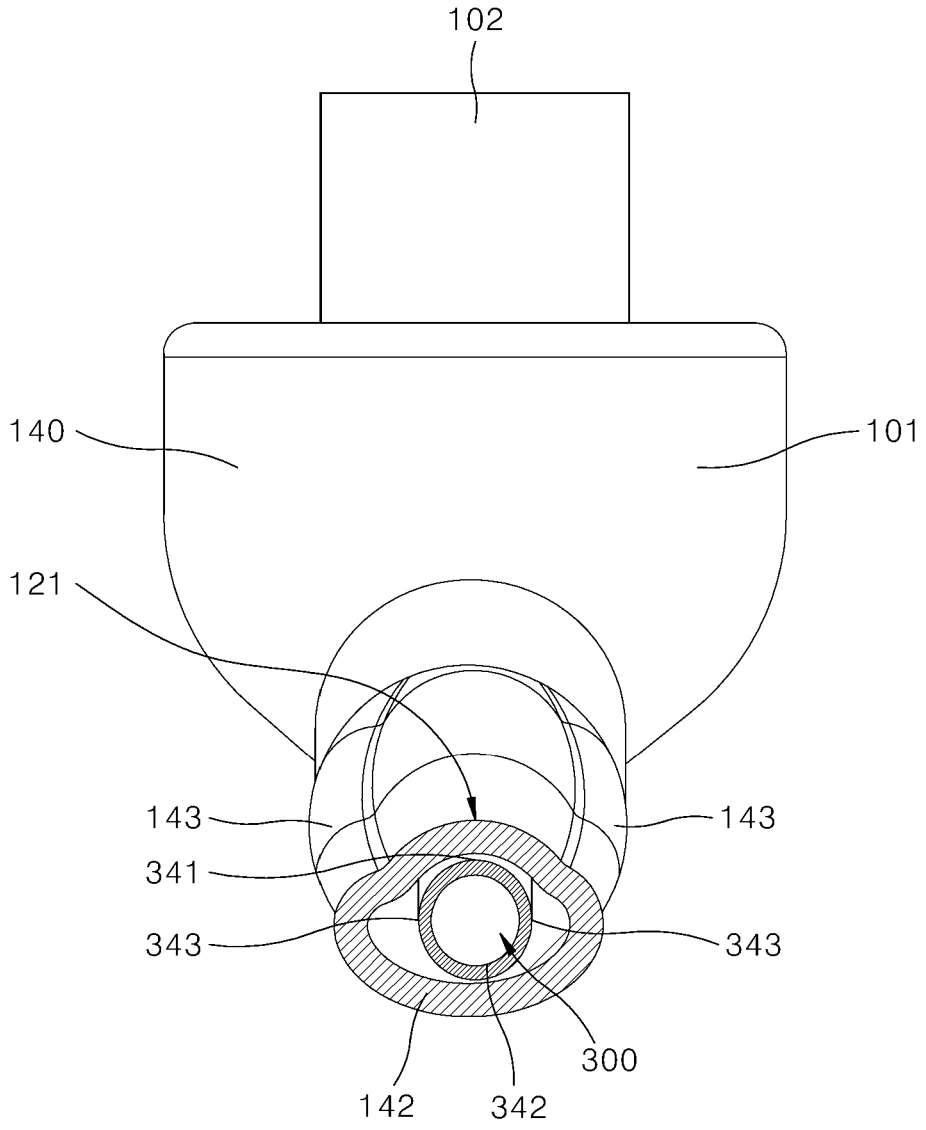
FIGS. 7 and 8 are respectively cross-sectional views of the first guide tube illustrated in FIG. 5.

Referring to FIG. 7, a portion of the upper surface 141 of the first guide tube 100, corresponding to the upper press part 121, may contact the upper surface 341 of the water supply tube 300, and a portion of the lower surface 142 of the first guide tube 100, corresponding to the upper press part 121, may contact the lower surface 342 of the water supply tube 300.

In the areas corresponding to the upper press part 121, the upper surface 341 and the lower surface 342 of the water supply tube 300 may be fixed based on a press in the upward and downward directions of the first guide tube 100.

At this time, both lateral surfaces 143 of the first guide tube 100 do not contact both lateral surfaces 343 of the water supply tube 300, thereby reducing insertion resistance of the water supply tube 300 in the upper press part 121 area.

Figure 8:
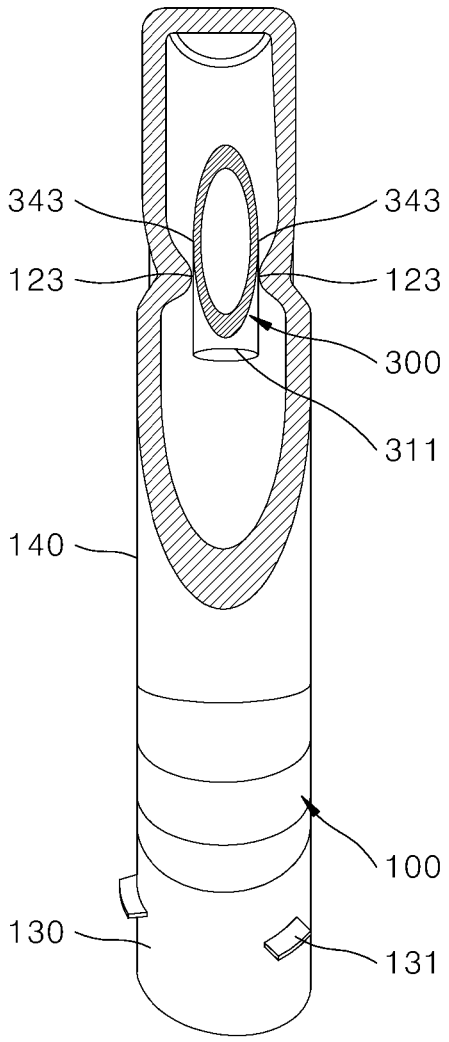

Referring to FIG. 8, a pair of lateral press parts 123 may be formed inside the first guide tube 100 and protrude to press both lateral surfaces 343 of the water supply tube 300.

For example, the lateral press part 123 may be disposed between the upper press part 121 and the lower press part 122, or disposed closer to the end portion 311 of the water supply tube 300 than the upper press part 121.

Since the lateral press part 123 is disposed not to overlap the upper press part 121 in the up-down direction as described above, insertion resistance of the water supply tube 300, which may occur in the case where the first guide tube 100 presses the upper surface, the lower surface and the lateral surfaces of the water supply tube 300 in all directions, may decrease significantly.

The water supply tube 300 disposed at a position corresponding to the position of the lateral press part 123 may be disposed along a center line of the lower surface of the first guide tube 100.

That is, the pair of lateral press parts 123 pressing both lateral surfaces 343 of the water supply tube 300 may be formed symmetrically.

According to the present disclosure, eccentrically discharged water, i.e., water that is discharged in such a way that the water is eccentric to the surface at one side of the first guide tube 100 while flowing in the first guide tube 100, may be prevented, such that frost is prevented from being grown as much as possible on the inner surface of the first guide tube 100, where water does not go past.

Further, according to the present disclosure, the first guide tube 100 may comprise press parts pressing the water supply tube 300 in the upward or downward direction and a press part pressing the water supply tube 300 in the lateral direction, to bend the water supply tube 300 disposed in the first guide tube 100 at a predetermined angle, and accordingly, the problem of position dispersion, which may occur in the case where the water supply tube 300 is inserted into the first guide tube 100, may be solved, thereby enhancing mass-production of products.

Figure 9:
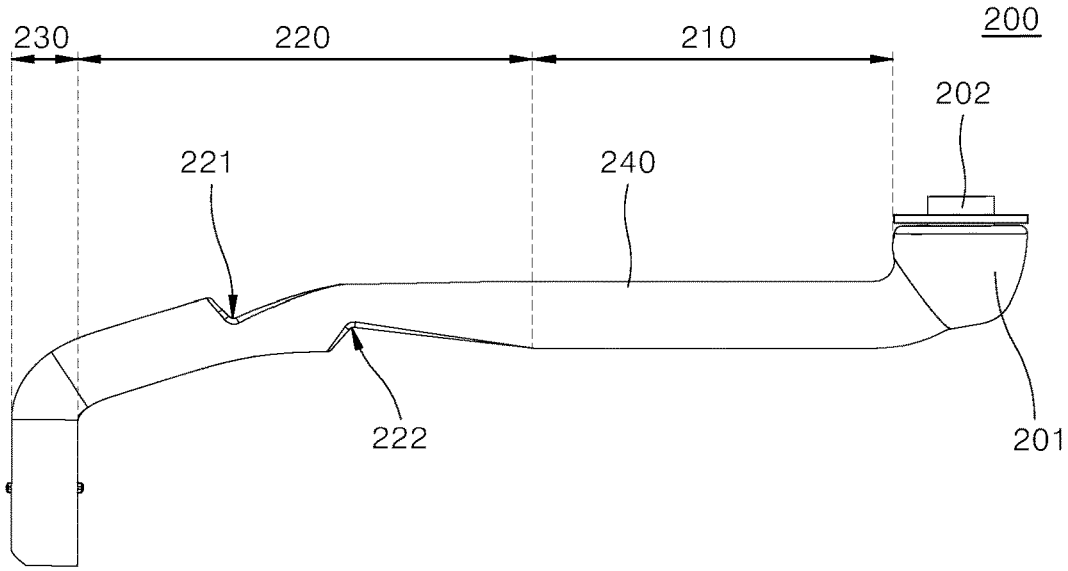
FIG. 9 is a side view of a second guide tube.

FIG. 9 shows the second guide tube 200.

The second guide tube 200 may comprise a connection part 201 that connects to the second pipe hole 44, and a tube body part 240 that is elongated from the connection part 201 in one direction.

The second guide tube 200 may form a water supply flow path through which water is guided to the ice maker 32.

A connection hole 202 open in the upward direction may be formed on the upper surface of one side of the connection part 201.

The connection hole 202 may fluidly communicate with the second pipe hole 44, and provide a passage through which the water supply tube 300 is inserted into the second guide tube 200.

The tube body part 240 may connect to the lateral surface of the other side of the connection part 202, and have a shape that extends approximately in the left-right direction.

The tube body part 240 may comprise a first extension part 210, a second extension part 220 and a third extension part 230 that connect consecutively along a direction in which water is discharged.

An upper press part 221 pressing the upper surface of the water supply tube 300 in the downward direction, and a lower press part 222 pressing the lower surface of the water supply tube 300 in the upward direction may be disposed at the second extension part 220.

The second guide tube 200 may be set in the same way as the first guide tube 100, except that the first extension part 210 of the second guide tube 200 has a length less than that of the first extension part 110 of the first guide tube 100.

Figure 10:
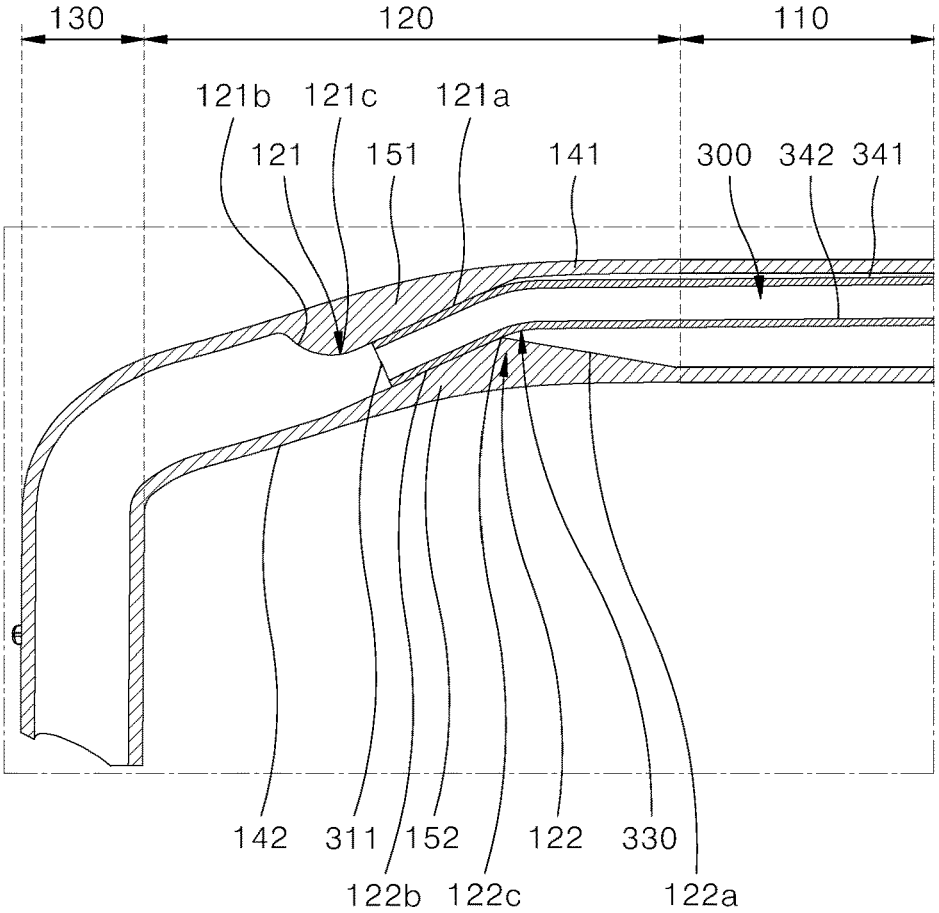
FIGS. 10 and 11 are respectively lateral cross-sectional views of a first guide tube of another embodiment.

Referring to FIG. 10, in the case of a first guide tube 100 of another embodiment, the upper press part 121 and the lower press part 122 may protrude respectively in the downward direction and the upward direction, without bending.

For example, an upper protrusion part 151 protruding in the downward direction may be formed in an area of the inner side of the first guide tube 100, corresponding to the upper press part 121.

Accordingly, in the case of the upper surface 141 of the outer side of the first guide tube 100, a surface corresponding to the upper press part 121 may be formed not to bend in the downward direction.

The upper protrusion part 151 may comprise a first side 121*a* comprised of a downward inclination surface and a second side 121*b* comprised of an upward inclination surface, while protruding in the downward direction.

A point of inflection 121*c* corresponding to a bend point of the upper protrusion part 151 may be formed between the first side 121*a* and the second side 121*b*.

Additionally, a lower protrusion part 152 protruding in the upward direction may be formed in an area of the inner side of the first guide tube 100, corresponding to the lower press part 122.

Accordingly, in the case of the lower surface 142 of the outer side of the first guide tube 100, a surface corresponding to the lower press part 122 may be formed not to bend in the upward direction.

The lower protrusion part 152 may comprise a first side 122*a* comprised of an upward inclination surface and a second side 122*b* comprised of a downward inclination surface, while protruding in the upward direction.

A point of inflection 122*c* corresponding to a bend point of the lower protrusion part 152 may be formed between the first side 122*a* and the second side 122*b*.

A bend part 330 of the water supply tube 300 inserted and fixed between the upper protrusion part 151 and the lower protrusion part 152 formed as described above may be formed at the point of inflection 122*c* of the lower protrusion part 152.

Further, the end portion 311 of the water supply tube 300 may be placed between the first side 121*a* of the upper protrusion part 151 and the second side 122*b* of the lower protrusion part 152, and respectively contact the upper protrusion part 151 and the lower protrusion part 152 and be fixed thereto.

Figure 11:
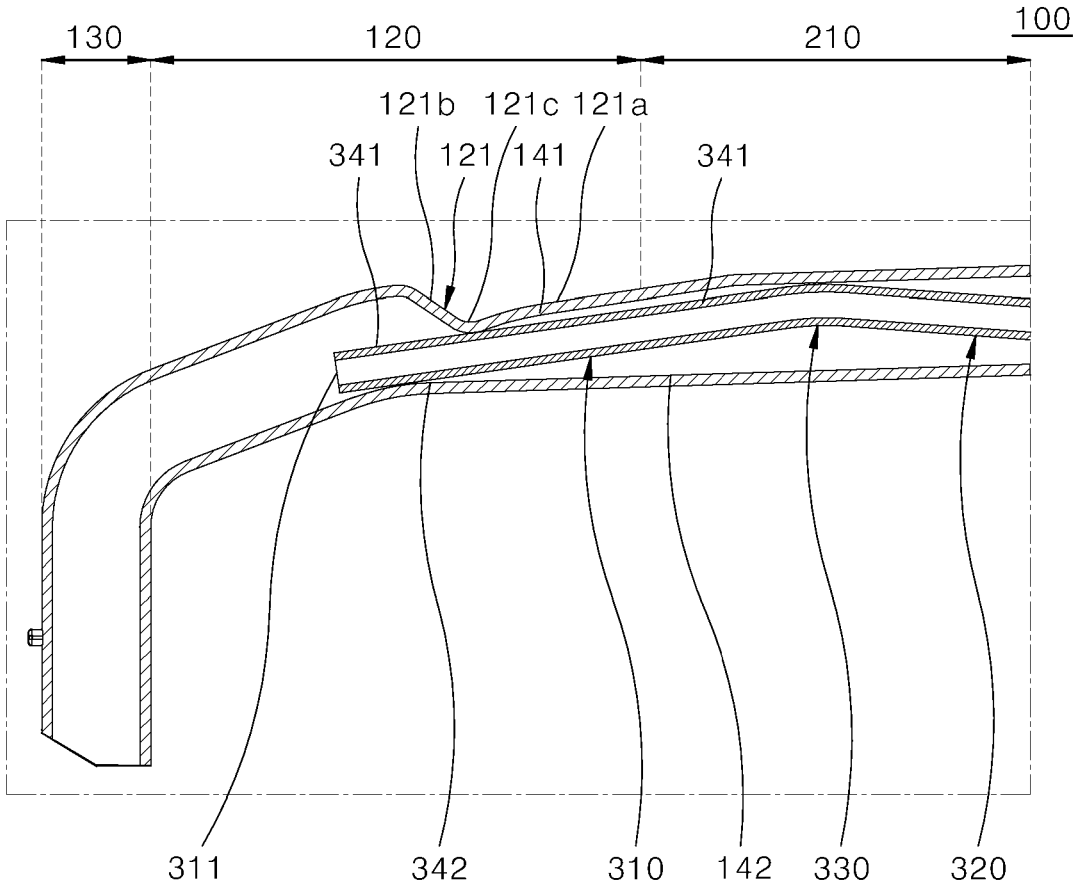

Referring to FIG. 11, in the case of a first guide tube 100 of another embodiment, the water supply tube 300 may be bent and fixed only by the upper press part 121.

For example, the upper press part 121 may press the front end portion 310 of the water supply tube 300, and the bend part 330 bending at the rear of the front end portion 310 may contact the upper surface 141 of the first guide tube 100.

Further, the rear end portion 320 of the water supply tube 300 may bend in such a way the rear end portion 320 contacts the lower surface 142 of the first guide tube 100.

At this time, the end portion 311 of the water supply tube 300 may be disposed closer to the third extension part 130 than the upper press part 121, and disposed closer to the lower surface 142 of the first guide tube 100 than to the upper surface 141 of the first guide tube 100.

The embodiments are described above with reference to a number of illustrative embodiments thereof. However, embodiments are not limited to the embodiments and drawings set forth herein, and numerous other modifications and embodiments can be drawn by one skilled in the art within the technical scope of the disclosure. Further, the effects and predictable effects based on the configurations in the disclosure are to be included within the range of the disclosure though not explicitly described in the description of the embodiment.

What is claimed is:

1. A refrigerator, comprising:

a cabinet that defines one or more storage compartments;

an ice maker disposed in one of the one or more storage compartments;

a guide tube that defines a water supply flow path configured to guide water toward the ice maker, the guide tube having a lower surface and an upper surface disposed above the lower surface; and a water supply tube disposed inside the guide tube and configured to supply water toward the ice maker, wherein the water supply tube has an end portion that faces the ice maker and is disposed closer to the lower surface of the guide tube than to the upper surface of the guide tube.

2. The refrigerator of claim 1, wherein the end portion of the water supply tube contacts the lower surface of the guide tube.

3. The refrigerator of claim 1, wherein the guide tube comprises an upper press part that protrudes in a downward direction from an inner side of the guide tube and is configured to press an upper surface of the water supply tube in the downward direction.

4. The refrigerator of claim 3, wherein a portion of the upper press part is curved in the downward direction.

5. The refrigerator of claim 3, wherein the guide tube further comprises an upper protrusion that is disposed at a portion of the upper press part and protrudes from an inner side of the guide tube in the downward direction.

6. The refrigerator of claim 3, wherein the guide tube further comprises a lower press part that protrudes in an upward direction from the inner side of the guide tube and is configured to press a lower surface of the water supply tube in the upward direction.

7. The refrigerator of claim 6, wherein a portion of the lower press part is curved in the upward direction.

8. The refrigerator of claim 6, wherein the guide tube further comprises a lower protrusion that is disposed at a portion of the lower press part and protrudes from an inner side of the guide tube in the upward direction.

9. The refrigerator of claim 6, wherein the end portion of the water supply tube is disposed closer to the upper press part than to the lower press part.

10. The refrigerator of claim 6, wherein a distance between the upper press part and the lower press part is greater than an inner diameter of the guide tube.

11. The refrigerator of claim 1, wherein the guide tube comprises a first extension part, a second extension part, and a third extension part that are connected to one another and consecutively arranged along a flow direction of water, wherein the second extension part defines a downward inclination surface that is included with respect to the first extension part, and wherein the guide tube is curved at the second extension part.

12. The refrigerator of claim 11, wherein the end portion of the water supply tube is disposed at the second extension part.

13. The refrigerator of claim 11, wherein the water supply tube comprises:

a first portion disposed at the first extension part and in contact with an upper surface of the first extension part; and a second portion disposed at the second extension part and in contact with an upper surface of the second extension part.

14. The refrigerator of claim 13, wherein the second portion of the water supply tube is further in contact with a lower surface of the second extension part.

15. The refrigerator of claim 11, wherein the end portion of the water supply tube is configured to discharge water toward the third extension part along a lower surface of the second extension part.

16. The refrigerator of claim 15, wherein the third extension part is configured to guide the water along an entire inner surface of the third extension part toward the ice maker.

17. The refrigerator of claim 11, wherein the third extension part extends in an up-down direction, and wherein an inclination angle of the third extension part with respect to a horizontal direction is greater than an inclination angle of the second extension part with respect to the horizontal direction.

18. The refrigerator of claim 1, wherein the guide tube comprises a pair of lateral press parts configured to press lateral surfaces of the water supply tube, respectively.

19. The refrigerator of claim 18, wherein a portion of the water supply tube is disposed between the pair of lateral press parts and extends along a center line of the lower surface of the guide tube.

20. The refrigerator of claim 1, wherein the one or more storage compartments comprise a first storage compartment and a second storage compartment, wherein the ice maker is disposed in the second storage compartment, and wherein the guide tube has (i) a first end in fluid communication with the first storage compartment and (ii) a second end in fluid communication with the second storage compartment.

21. The refrigerator of claim 20, wherein the guide tube is disposed between the first storage compartment and the second storage compartment, wherein the refrigerator further comprises a wire that is disposed along an outer surface of the guide tube and configured to transfer heat to the guide tube, and wherein the guide tube passes through a foaming area defined between the first storage compartment and the second storage compartment.

* * * * *